US005252106A

United States Patent [19]

Hallisy

[11] Patent Number: 5,252,106

[45] Date of Patent: Oct. 12, 1993

[54] BASE EXTRACTABLE PETROLEUM MARKERS

[75] Inventor: Michael J. Hallisy, Woodstock, Ill.

[73] Assignee: Morton International, Inc., Chicago, Ill.

[21] Appl. No.: 921,547

[22] Filed: Jul. 29, 1992

[51] Int. Cl.[5] ..... C10L 1/22

[52] U.S. Cl. ..... 44/328; 44/327; 534/653; 534/654

[58] Field of Search ..... 44/327, 328; 534/653, 534/654

[56] References Cited

U.S. PATENT DOCUMENTS

| | | | |
|---|---|---|---|
| 3,073,664 | 1/1963 | Spazer et al. | 44/328 |
| 3,704,106 | 11/1972 | Orelup | 44/328 |
| 4,000,985 | 1/1977 | Orelup | 44/328 |
| 4,011,209 | 3/1977 | DeFeo et al. | 44/328 |
| 4,210,414 | 7/1980 | Hansen et al. | 44/328 |
| 5,156,653 | 10/1992 | Friswell et al. | 44/328 |

*Primary Examiner*—Ellen M. McAvoy
*Attorney, Agent, or Firm*—Wayne E. Nacker; Gerald K. White

[57] ABSTRACT

Liquid petroleum products are marked with markers having the formula:

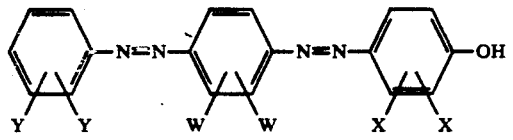

where the Ws are selected from O—($C_1$–$C_3$alkyl) and hydrogen, provided that at least one W is O—($C_1$–$C_3$alkyl), the Xs and Ys are the same or different and are selected form hydrogen, alkyl, substituted alkyl, alkenyl, substituted alkenyl, aryl, substituted aryl, fused aryl, substituted fused aryl, halogen, nitro, cyano, and alkoxy.

4 Claims, No Drawings

BASE EXTRACTABLE PETROLEUM MARKERS

The present invention is directed to the tagging of petroleum products with silent markers and to detection of such markers in petroleum products.

BACKGROUND OF THE INVENTION

It is known to tag petroleum products with markers, as for example, as taught in U.S. patent application Ser. No. 07/687,255 filed Apr. 18, 1991, the teachings of which are incorporated herein by reference.

A dye is defined herein as a material lending visible color when dissolved in the dyed product. Examples of dyes which have been used for dyeing organic liquids are Color Index Solvent Red #24, Solvent Red #19, Solvent Yellow #14, Solvent Blue #36, and Solvent Green #3.

A marker is defined herein as a substance which can be dissolved in a liquid to be identified, then subsequently detected by performing a simple chemical or physical test on the tagged liquid. Markers that have been proposed, or are in use, include furfural, quinizarin, diphenylamine and radioactive materials. (Radioactive materials have not been accepted in Western countries because of special equipment and precautionary measures associated with their handling.)

Dyes and markers are needed to clearly distinguish chemically or physically similar liquids. As one example, fuels are dyed or tagged to provide visually distinctive brand and grade denominations for commercial and safety reasons. As another example, some lightly taxed products are dyed or tagged to distinguish them from similar materials subject to higher taxes. Furthermore, certain fuels are dyed or tagged to deter fraudulent adulteration of premium grade products with lower grade products, such as by blending kerosene, stove oil, or diesel fuel into regular grade gasoline or blending regular grade gasoline into premium grade gasoline. Identification of particular batches of bulk liquids for protection against theft is another valuable function of markers and dyes, particularly for identifying fuels owned by large government, military or commercial consumers. Finally, marketers of brand name products dye or tag their products to detect substitution of others' products in their distribution system.

Dyes alone are not always adequate to securely and reliably identify liquids. Many dyes are easily removed by unauthorized persons. Furthermore, dyes can be obscured by other natural or added substances (particularly dyes present at low concentrations in a mixture of fuels). Because dyes alone have these shortcomings, a combination of a dye and a marker often is used to tag an organic liquid.

Above-referenced U.S. patent application Ser. No. 07/687,255 recites important characteristics of certain desirable markers for petroleum include:

1. are entirely foreign to the liquids;
2. can be supplied as highly concentrated solutions in petroleum-compatible solvents;
3. are easily detected by a simple field test;
4. are not obscured by unstable natural components of the liquids;
5. are stable over the anticipated storage life of the tagged liquid (usually three to six months); and
6. have identities which can be confirmed by laboratory methods.

The dyes of the present invention fulfill requirements of 1-6 above. The markers of the present invention are "silent" in that at the levels at which they are used, they provide substantially no color to the petroleum product, but undergo a reaction during a detection procedure. The silent nature of the markers of the present invention make them particularly suitable as markers in non-dyed petroleum products, but they are suitable in dyed petroleum products, as well, where the markers do not alter the color imparted by the dyes. The silent nature of the markers of the present invention also is advantageous in that they cannot be detected without an appropriate reactive extraction system, making misuse or dilution of a petroleum product mixed with a marker of the present invention more difficult.

A suitable petroleum marker that is to be extracted by a petroleum-immiscible solution must meet somewhat demanding solubility requirements. In the final product, the marker is only present in the petroleum product in parts-per-million quantities, but the marker is desirably provided to the petroleum in concentrated form, either in a petroleum product or in a petroleum-miscible solvent. On the other hand, a small amount of extractant should remove substantially all of the marker from the specimen of petroleum product being tested.

An object of the invention is to provide a family of homologous markers which can be differentiated by more rigid analysis, whereby different markers can be provided for different grades of petroleum product or to different customers.

Markers of the present invention are also advantageous is that they provide relatively quantitative determinations. Most markers are adequate for detection of their presence in petroleum product; however, many available markers do not provide a good quantitative measurement of their levels in liquid petroleum products. Quantitative determinations are particularly important in cases where dilution is suspected, e.g., dilution of a higher-taxed fuel with a lower-taxed fuel.

SUMMARY OF THE INVENTION

In accordance with the present invention, liquid petroleum products are tagged with a marker of the general class of chemicals described as phenylazophenols. Markers at levels of about 0.25 parts per million (ppm) or above (usually at least about 1 ppm) are added to liquid petroleum products. The markers may be detected in the petroleum products by extraction with an alkaline aqueous solution. This alkaline aqueous solution not only extracts the marker from the liquid petroleum product, but causes the marker to react, producing a clearly defined color that identifies the petroleum product as to source, permitted use, etc.

The present invention further provides novel compounds particularly suitable as markers for petroleum products.

DETAILED DESCRIPTION OF CERTAIN PREFERRED EMBODIMENTS

The markers of the present invention have the general formula:

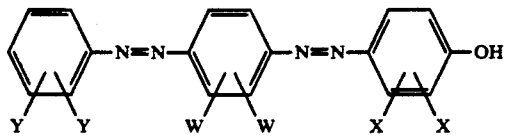

where the Ws are selected from O—($C_1$–$C_3$alkyl) and hydrogen, provided that at least one W is O—($C_1$–$C_3$alkyl), the Xs and Ys are the same or different and are selected from hydrogen, alkyl, substituted alkyl, alkenyl, substituted alkenyl, aryl, substituted aryl, fused aryl, substituted fused aryl, halogen, nitro, cyano, and alkoxy. Preferably, the Xs are each di-sec-butyl and are at the 2 and 6 positions of the phenol moiety. Preferably at least one Y is hydrogen. Preferably, both Ws are O—($C_1$–$C_3$alkyl); most preferably these are para to each other. Preferably Ys are electron-withdrawing, e.g., halogen, nitro and cyano.

These compounds are conveniently synthesized by azo coupling of an appropriately substituted aniline to a phenol, such as 2,6-di-sec-butyl phenol.

Compounds of this general formula are generally pale red and at the end use levels, e.g., 0.25–100 ppm, in petroleum product are not readily observable to the naked eye. On the other hand, in alkaline aqueous solution, the salt is generally a deep color having a high blue component. The Xs and Ys in the formula may be varied to adjust solubility. Preferably, the compounds are soluble to at least 10% in a high boiling aromatic solvent. (By high boiling is meant having a boiling point of about 200° C. or above.) Some compounds in accordance with the invention have solubilities in high boiling aromatic solvent of 40 to 50%, enabling a very concentrated marker solution to be provided. Because X and Y can be varied, a family of homologous markers is provided. Different members of the family can be provided for different grades of petroleum, different end uses of petroleum or different suppliers of petroleum. While the homologous markers may not be distinguishable from each other in a crude field test, they can be distinguished with more sophisticated analytical apparatus.

The final amount of marker in the tagged liquid petroleum product will depend upon a variety of factors. It is generally necessary to have at least about 0.25 ppm in the finally tagged liquid petroleum product. Usually, however, a somewhat greater amount will be provided, e.g., 5–40 ppm, enabling the marker to be detected, should the tagged petroleum product be diluted with untagged petroleum product. It is generally desirable to provide an amount of marker that might be detected in a simple field test. Of course, where sophisticated testing equipment is available, it may be possible to use even less marker.

Extraction of the marker from the tagged petroleum product may conveniently be carried out with a dilute, e.g., 1–3%, aqueous solution of an alkaline such as NaOH or KOH. Preferably, the extraction solution also includes a water-miscible, petroleum-immiscible organic solvent, such as methanol. A suitable extraction solution, for example, is a 50/50 by volume mixture of water and methanol containing 2% by weight NaOH. The base forms a salt with the phenolic —OH, resulting in development of the color and also changing the solubility of the marker so that it is substantially less soluble in petroleum and substantially more soluble in aqueous medium.

Typically the volume ratio of extraction mixture to liquid petroleum is between about 1:1 and about 1:40. If marker is present in the petroleum product, it will be extracted by the aqueous layer and colored by reaction with the extraction mixture. Colorometric equipment may be used to quantify the amount of marker in the aqueous layer. As long as similar conditions, e.g., volume-to-volume, ratios are used for similar liquid petroleum products, the color that is produced is relatively quantitative. The test is not "quantitative" in the strict sense that exact levels of marker can be tested in tagged petroleum. This is due in large part to the nature of petroleum products which are mixtures of a wide variety of compounds. Depending upon the particular batch of petroleum product, the level of impurities extractable by the extraction solution may vary. However, in tests conducted according to the present invention, it is generally possible to determine marker levels to within about 5%.

One of the advantages of the invention is the simplicity of the qualitative test afforded by the markers and extraction/development solutions. Experience has indicated that inspectors in the field are often adverse to performing all but the most simple tests. The test as indicated above is a quick, one-step test. Convenience can be enhanced by providing an inspector a premeasured amount of extractant solution in an extraction vial and, preferably, means to measure an appropriate amount of petroleum product. For a rough estimate of marker level, the inspector might even be provided with a color chart against which to compare the developed color.

The invention will now be described in greater detail by way of specific examples.

EXAMPLE 1

2,6-Di-sec-butyl-4-(2',5'-dimethoxy-4'-(4''-nitrophenylazo))phenyl azo phenol

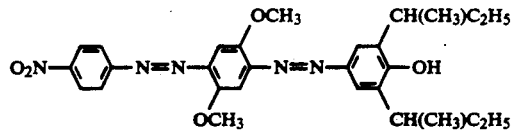

Di-sec-butylphenol, 1.03 g, was mixed with sodium carbonate, 0.3 g, in a small amount of ice water and toluene. A solution of Fast Black K Salt, 2.09 g (Aldrich) in a small amount of ice water was added. After stirring cold for one hour, the mixture was made slightly acidic with acetic acid, and the layers were separated. The solvent was evaporated leaving 2.33 g residue (84%). The last readily formed a 50% solution in Aromatic 200 solvent.

When 40 ml of a 50 ppm solution of the product solution in kerosene was extracted with 4 ml of 2½% NaOH in 50% aqueous methanol, a deep blue-green color was obtained. The color was still detectable in similar extracts for 10 ppm solution.

EXAMPLE 2

2,6-Di-sec-butyl-4-(2',5'-dimethoxy-4'-phenylazo)-phenylazo phenol

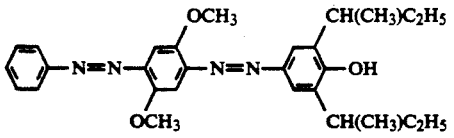

A solution of 2,5-dimethethoxy-4-phenylazo aniline (prepared by known methods), 1.67 g, in a small amount of toluene, was mixed with conc Hcl, 1.5 ml, and a small drop of Sotex N (surfactant). A solution of sodium nitrite, 0.45 g, in a minimal amount of water was added to the stirred cold mixture. Stirring was continued until a clear diazonium salt solution had formed.

This mixture was then added to a cold, stirred mixture of di-sec-butyl phenol, 1.2 g, sodium carbonate, 0.3 g, and sodium hydroxide, 0.5 g, in ice water and a small amount of toluene.

The reaction mixture was stirred at ice bath temperature for several hours, then acidified with acetic acid. The layers were separated and the solvent removed, leaving a dark oil. The product readily formed a 50% solution in Aromatic solvent.

When 40 ml of 10 ppm solution of the product solution in kerosene was extracted with 4 ml of 2½% NaOH in 50% aqueous methanol, a deep blue color was obtained. The color was still detectable in similar extracts from 1 ppm solution.

EXAMPLE 3

2,6-Di-sec-butyl-4-(2',5'-dimethoxy-4'-(3'',4''-dichloro phenyl azo))phenyl azo phenol

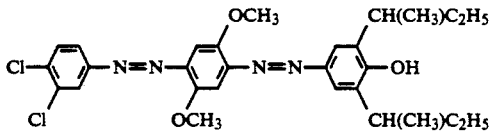

This compound was prepared in a manner similar to the compound prepared in example #2. This compound gave a green-black extract.

EXAMPLE 4

2,6-Di-sec-butyl-4-(2',5'-dimethoxy-4'-(5''-chloro-2''-metyl phenyl azo))phenylazo phenol

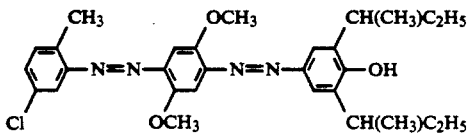

This compound was prepared in a manner similar to the compound prepared in Example #2 above. This compound gave a bright blue extract.

EXAMPLE 5

2,6-Di-sec-butyl-4-(2',5'-dimethoxy-4'-(2''-methoxy-5''-methyl) phenylazo))phenylazo phenol

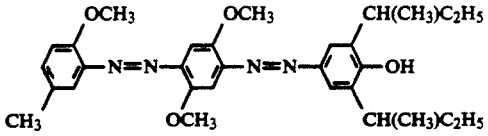

This compound was prepared in a manner similar to Example #2. This compound gave a grey-black extract.

EXAMPLE 6

2,6-Di-sec-butyl-4-(2',5'-dimethoxy-4'-(2''-methoxy phenyl azo))phenylazo phenol

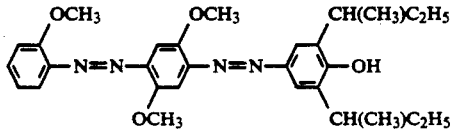

This compound was prepared in a manner similar to Example #2. This compound gave a grey-black extract.

EXAMPLE 7

4-(2,5-Dimethoxy-4-(phenylazo)phenylazo)naphth-1-ol

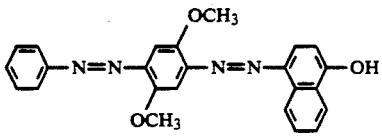

This compound was prepared in a manner similar to #2. This compound gave a blue extract.

EXAMPLE 8

4-(2,5-Dimethoxy-4-(dimethylphenylazo)phenylazo)-naphth-1-ol

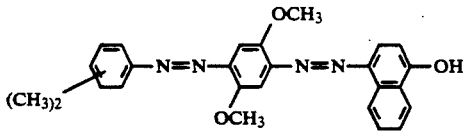

This compound was prepared in a manner similar to Example 2. This compound gave a blue-black extract.

While the invention has been described in terms of certain preferred embodiments, modifications obvious to one with ordinary skill in the art may be made without departing from the scope of the present invention.

Various features of the invention are set forth in the following claims.

What is claimed is:

1. A method of marking a liquid petroleum product and identifying the petroleum product so marked comprising adding to said liquid petroleum product a detectable level of a marker having the formula:

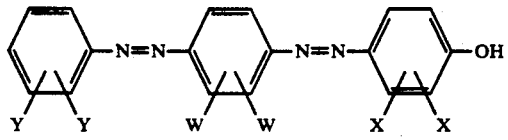

where the Ws are selected from O—($C_1$–$C_3$alkyl) and hydrogen, provided that at least one W is O—($C_1$–$C_3$alkyl), the Xs and Ys are the same or different and are selected form hydrogen, alkyl, substituted alkyl, alkenyl, substituted alkenyl, aryl, substituted aryl, fused aryl, substituted fused aryl, halogen, nitro, cyano, and alkoxy; extracting said marker from said petroleum product with an alkaline aqueous medium; and observing the color of said marker in said alkaline aqueous medium.

2. A method according to claim 1 wherein the Xs are each di-sec-butyl and are at the 2 and 6 positions of the phenol moiety.

3. A method according to claim 1 wherein both Ws are O—($C_1$–$C_3$alkyl).

4. A method according to claim 1 wherein said Ws are para to each other.

* * * * *